United States Patent [19]

Schneider

[11] 4,418,832

[45] Dec. 6, 1983

[54] CONTAINER WHICH CAN BE OPENED WITH ONE HAND

[75] Inventor: Helmut Schneider, Baar, Switzerland

[73] Assignee: Inkares AG, Zug, Switzerland

[21] Appl. No.: 385,213

[22] Filed: Jun. 4, 1982

[30] Foreign Application Priority Data

Jun. 25, 1981 [CH] Switzerland ..... 4209/81

[51] Int. Cl.[3] ..... B65D 17/50; B65D 41/02

[52] U.S. Cl. ..... 220/260; 220/288; 215/295

[58] Field of Search ..... 220/260, 288, 306; 215/295; 206/1.5

[56] References Cited

U.S. PATENT DOCUMENTS 3,226,002 12/1965 Walker ..... 220/288

3,385,461 5/1968 Mallin ..... 220/288

*Primary Examiner*—George T. Hall

*Attorney, Agent, or Firm*—Neuman, Williams, Anderson & Olson

[57] ABSTRACT

A container is provided with an annular support flange, which can be flat or rise inwards in a frustum-defining manner. The flange is connected to the container contents-containing base portion in the vicinity of the lower edge of the cover when in the seated position. The flange's upwardly directed surface is smooth. The support flange is used for supporting the fingers during removal of the cover. The normally vertical periphery of the cover is constructed in such a way that upward slippage of the fingers is prevented.

18 Claims, 12 Drawing Figures

CONTAINER WHICH CAN BE OPENED WITH ONE HAND

BACKGROUND OF THE INVENTION

This invention relates to a container such as a jar, can or the like which can be opened with one hand, and more particularly pertains to a receptacle for receiving the product and a cover or lid placed on the receptacle which is removable with one hand.

Any user of domestic products in paste form, cosmetics and the like is well acquainted with the packaging thereof in containers having a large variety of seals, closures, lids and caps. Snap-on caps made from elastic materials, screw-on caps, plug-in covers, locking covers and so-called patent stoppers which to a certain extent facilitate opening and closing are commercially available in a number of various forms.

Many products require an air-tight or liquid-tight container, but other less demanding products require only a certain degree of sealing, because they are used up relatively rapidly or are insensitive to drying out. Other products are used so rarely that the ease of opening and closing does not really justify any expenditure relating to closures therefor.

However, there are numerous paste or cream products packed in containers which are used at least once daily and where great importance is attached to the easy opening and closing of the container. Examples of such products are cosmetics and shoe creams and polishes. The group of frequently used containers is illustrated by means of two examples hereinafter described.

Containers for cosmetics are generally equipped with screw-on or plug-in caps or covers and require both hands to open them. The base or receptacle with the product must be held with one hand and the upper part or cover must be turned or drawn off with the other hand. In order to be able to exert an appropriate force, the user removes the container from the table and holds it tightly against the body. Particularly in the case of a plug-in cover, this can lead to an uncontrolled, sudden opening, with the risk of soiling the clothes of the manipulator, or the slipping of the suddenly separated parts. As a result, the exposed contents of the container may be spilled and wasted.

The problem is similar, and even more marked in the case of shoe creams. In connection with the latter it is also necessary to hold the shoe, as well as the brush or cloth. If one of these objects is being held in the hand before opening the container, it must first be set down and then taken up again.

A container is also known which is externally pressed at a marked point on the edge of the cover so that the latter flips open. The then sloping cover is gripped and lifted off. However, this cover opens so suddenly that not only are the contents seriously shaken up by the violent vibration and shaking, but they can even escape and be lost. The attempt is then made to raise the container from the table and press it between the thumb and index finger, while the lifting part of the cover edge of the opposite side is kept under control by the other hand. However, as this container is normally not provided with a non-slip covering, it is easy for the finger exerting the pressure to slip off. As a result, the cover part flips open so that the container, with or without the loosely resting cover, is catapulted away, with the obvious deleterious consequences. In order to be able to open the container in a relatively reliable and safe manner, it is necessary to turn it so that the pressure point faces toward the user, after which pressure is applied, enabling the cover to be gripped and placed aside. When closing, care must be taken to ensure that too much pressure is not exerted at the pressure point, as otherwise the cover slopes up and, in certain circumstances, even drops down again.

Two-handed operation is also required in the case of the frequently used container having a lever which is rotatably mounted on the side of the container base or to the cover by means of a pivot. The pivotal lever is adapted to press on a projecting edge of the cover or underlying container during its rotation. One hand holds the container and the other turns the lever. When reseating the cover, the lever must again be turned back into its initial position, otherwise closing is not possible.

BRIEF SUMMARY OF THE INVENTION

The present invention relates to a container, which obviates the aforementioned disadvantages and which easily and safely permits the opening and closing of the container resting on a substrate with only one hand. The provided container comprises only two, and a maximum of three parts. The container is easy to use so that its operation is immediately apparent to anyone viewing the same. Any superfluous manipulation of the container before, during or after opening or closing is avoided. The product in the container is not damaged or otherwise adversely affected during opening and closing. The fingers and supporting surface of the container remain clean, as there is no spillage occasioned by jerky, uncontrolled movement during opening and closing.

In one embodiment of the invention there is provided a container comprising a base or receptacle portion containing a product such as a cream or paste. A cover is received over the upper periphery of the base in a snap-on, friction fit. The container base portion has a support flange disposed about at least a portion of the base periphery over which the cover may be disposed. The flange has a width which supports the fingers of the container user in the normal course of cover removal. The finger supporting flange may taken several forms as will be hereinafter described.

BRIEF DESCRIPTION OF THE DRAWINGS

The invention is described in greater detail in connection with the hereinafter described illustrative embodiments of the attached drawings, wherein the various views show in.

DETAILED DESCRIPTION OF THE PREFERRED EMBODIMENTS

Figure 1:
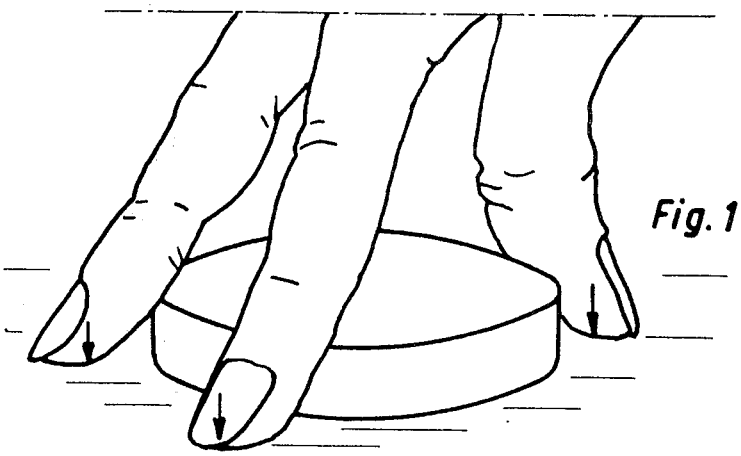
FIG. 1 the first phase of the process of raising a difficult-to-remove cover member.
Figure 2:
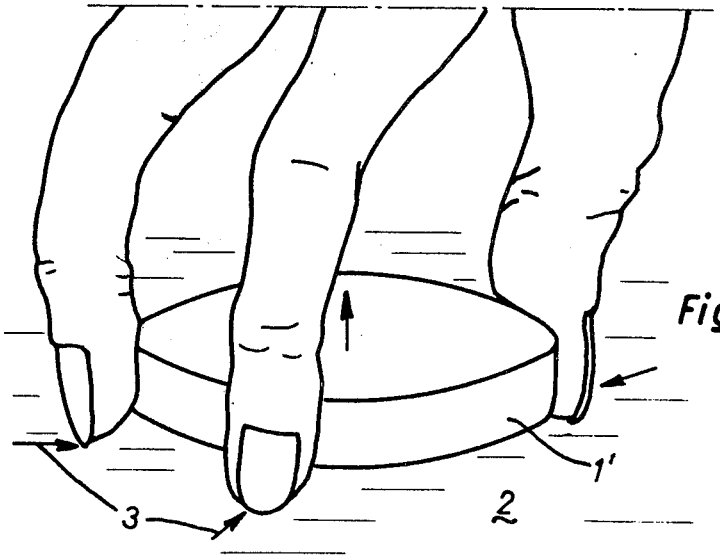
FIG. 2 a second phase of the cover removing process.

Proper operation of the container of this invention will be made apparent by first examining the prior art embodiment shown in FIG. 1. A flat member or object is adhered to a substrate as illustrated, and an attempt to lift it off the latter is prevented by the adhesive connection. If no tools are available for removing the object, some other procedure must be adopted. To this end consciously or unconsciously a type of leverage is used, as shown in FIGS. 1 and 2. FIG. 1 shows the initial positions of the fingers disposed about the periphery of the object on the substrate. The inner surfaces of the fingers are in contact with the edge of the object as shown.

FIG. 2 shows the normal subsequent movements wherein simultaneously the fingers slide on the substrate towards the object, increase their grip on the latter and push off upwardly from the substrate. The object is then lifted off the substrate with considerable force, as the adhesive joint cannot withstand the above applied separation force and gives way. What has happened here is simply the use of the fingers as levers, which were supported on the substrate, and when using the counter-pressure of the latter were able to force the object away from the substrate in the upward direction.

Thus, the important point to be noted from FIGS. 1 and 2 is the ability to obtain support on a support surface. The problem of removing a fixed container cover which offers resistance during the removal attempt, is consequently the same as that of removing an object adhered to a substrate. If the container cover is considered as the object stuck to the substrate and the container base or contents container as the substrate, it necessarily follows that a support surface must be made available to enable the fingers to be used as levers. The finger pressure thus acts on the support surface and consequently the base, but the removing tension or force acts on the cover to be removed. This finger support surface must be positioned in such a way that it is independent of the presence of a substrate, so that in theory the container could also be opened freely in space. However, due to the fact that the container base would then drop, it is preferable to perform the opening process on a substrate, such as e.g. a table.

Figure 3:
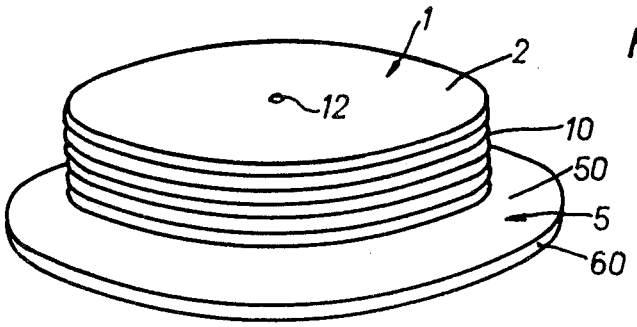
FIG. 3 a perspective view of a first embodiment of a container made in accordance with this invention.
Figure 4:
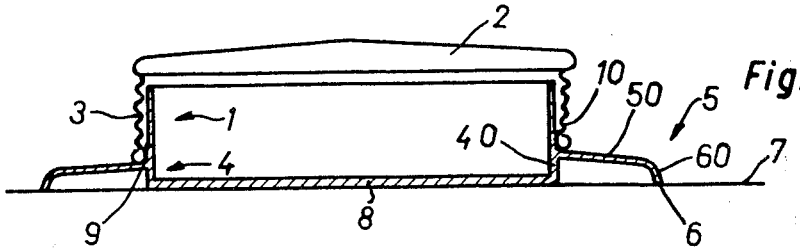
FIG. 4 is a cross-section through the embodiment of FIG. 3.

A first embodiment of a container corresponding to the aforementioned conditions and made pursuant to this invention is shown in FIGS. 3 and 4. This container has a cover 1 with an upper part 2 and cylindrical portion 3, as well as a lower part or product-containing base 4. The base is surrounded by a support flange 5, which acts as a support surface for the fingers. The support flange 5 need be no wider than is absolutely necessary, and thus a width which permits the supporting of the fingers of the cover manipulator is adequate.

Various embodiments of the support flange are possible. In FIGS. 3 and 4 its outer edge 6 is in the plane 7 of bottom 8 of base 4. The point at which the support flange is connected to the base, i.e., shoulder 9 can be located above the bottom 8 as shown in FIG. 4. Starting from the shoulder point 9, support flange 5 has a frustum-shaped portion 50, which passes into a sharply curved edge portion 60, which terminates in outer distal edge 6.

Support flange 5 can be formed integrally in one piece to the base 4. Flange 5 can also be constructed independently of the base so that it is fitted subsequently, i.e., after the mechanical filling of the container so that it does not impair the container filling operation. The flange-base connection is a function of the material of fabrication, and the juncture at shoulder 9 can take place by adhesion, soldering or welding. However, the separate construction of a support flange and base can also be used to enable the support flange to be detached from an empty container after its contents have been used up and then placed on a new, full container.

Figure 10:
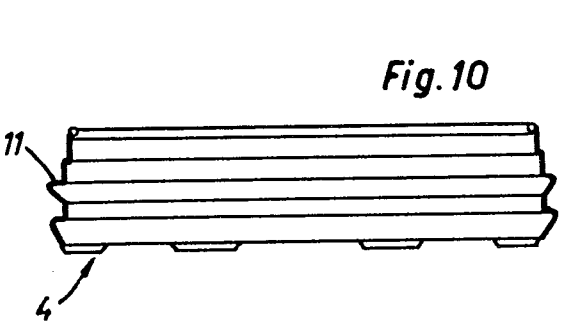
FIG. 10 a side view of the base of FIG. 9.
Figure 9:
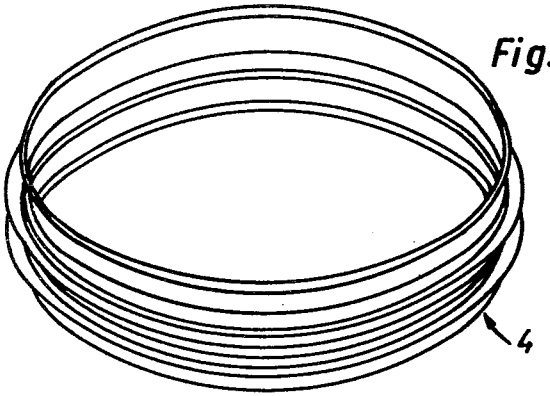
FIG. 9 a perspective view of a container base anchor rings or tori of corresponding shape adapted for engagement of an elastic support flange.
Figure 12:
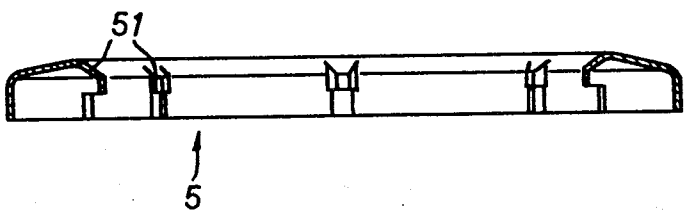
Figure 11:
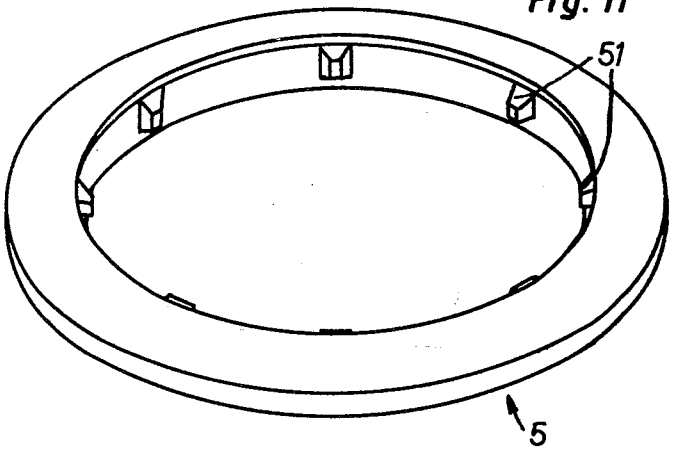
FIG. 11 a perspective view of a support flange for engaging on the base rings of FIGS. 9 and 10, and in FIG. 12 a cross-section through the support flange of FIG. 11.

However, it is important in this connection that there is a portion on base 4, which is constructed in such a way that the support flange can interengage with it. This portion can e.g. comprise one or two spaced, base-encompassing tori 11, of which only one is shown in FIG. 10, and on it can be supported support flange 5, e.g. by means of flange projections 51 (FIGS. 11 and 12).

The surface of support flange 5 should be made as smooth as possible, so that the sliding movement of the fingers thereover is not impeded. However, the vertical, i.e., cylindrical portion 2 of cover 1 should advantageously have a rough, non-slip surface and can be in the form of one or more peripheral tori, ribs, or the like, or a staircase or shark's tooth profile preventing an upward slipping of the fingers. As an example, FIG. 4 shows several ribs 10.

The outer edge 6 of the support flange and/or the lower surface of bottom 8 of base 4 can also be slip-proof. In both cases it is possible to provide on at least a portion of the surfaces of these elements a coating of deformable plastic or latex (not shown).

It is clear that the fingers for removing cover 1 can also assume some other position.

The removal of the container cover 1 is also facilitated if it has a small opening 12 (FIG. 3) in the center, and as a result the partial vacuum which would otherwise be generated on lifting the lid is avoided. It is otherwise virtually impossible to remove covers fitted with minimum tolerances relative to their bases.

Figure 5:
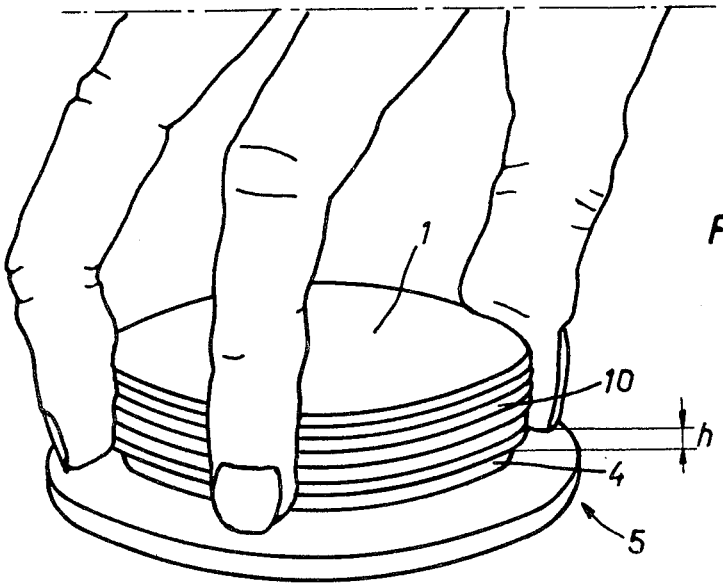
FIG. 5 the same raising phase as illustrated in FIG. 2, but as applied to the container of FIG. 3.
Figure 6:
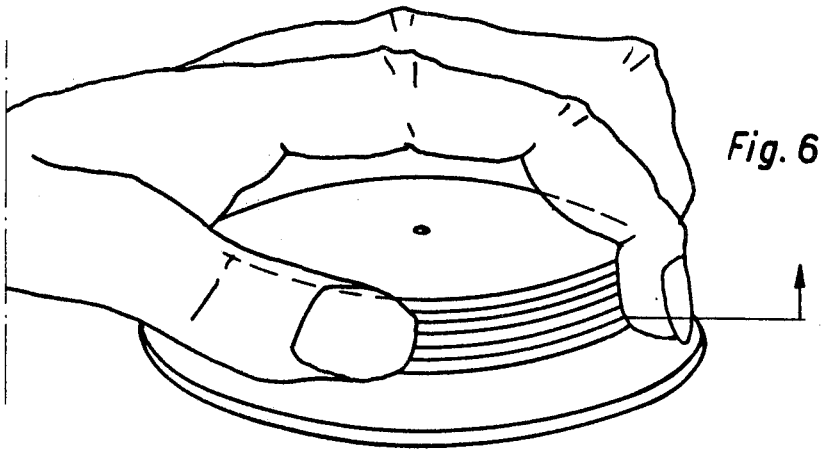
FIG. 6 the same embodiment of the container of FIGS. 3 and 4 with a different positioning of the fingers when removing the cover.

As can be surmised from FIG. 5, the great advantage of the provided container is that only one hand is required for lifting off the cover. The fingers not only insure the actual cover removal, but at the same time press the base 4 against the substrate due to the pressure of the support flange connected to the base, and prevent any sliding away thereof, at least until the cover has been raised by height h.

Figure 7:
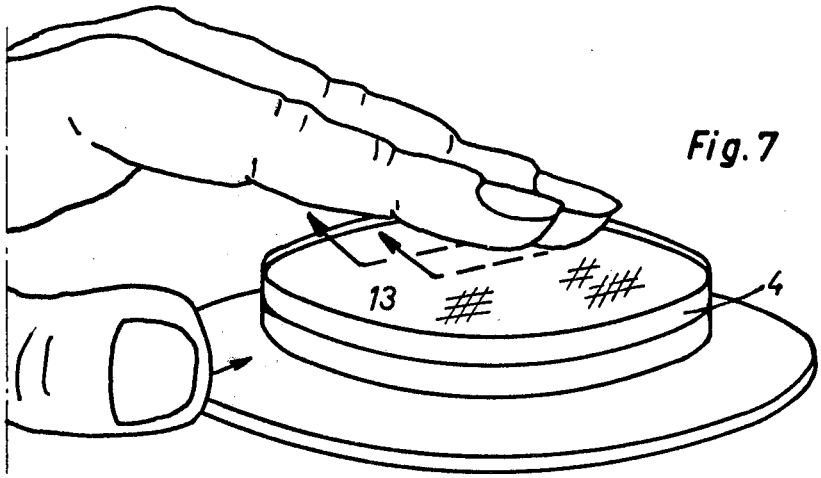
FIG. 7 the removal of the container contents by hand from a non-slip-proof container of this invention, showing the counter-holding with the thumb without contact with the container contents.

This advantage of single-handed operation is also shown in FIG. 7 when using an open container (only base 4 and support flange 5 are shown) containing a paste-like material, e.g. skin cream. The thumb supports support flange 5, whereas the index or middle finger simultaneously performs a cream-engaging movement on the contents surface in the direction of arrows 13. It is immediately apparent that only those fingers come into contact with the cream contents that will be subsequently used for rubbing the skin cream onto the intended point, e.g. the face. However, the thumb, which is virtually never used for rubbing-in purposes, remains outside the contact area. This is not the case with conventional containers whose outside must be held with the thumb, so that the contents can also understandably contact the thumb. However, as in FIG. 5 the thumb prevents the slippage of the container relative to the user. In certain applications there is no need for such containers to be provided with a nonslip coating on the bottom surface.

Figure 8:
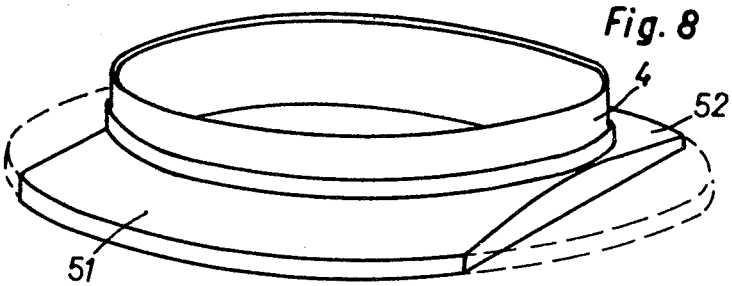
FIG. 8 a perspective view of another embodiment of a container made pursuant to the provided invention.

FIG. 8 shows a variant of a container of this invention in which the annular support flange 5 is reduced to two diametrically facing partial flanges 51, 52. In the embodiment of FIG. 8 it is not possible to lift off the cover in any random position of the container and rotation of the container may be required. However, the advantage of the FIG. 8 structure is that of space saving so that the individual containers can be moved closer together.

The particular advantages of the containers made in accordance with this invention are that it only has a few parts. Also it can be opened rather effortlessly and closed with one hand. The contents can also be removed with one hand and without contact with the thumb. The provided container can thus be opened in a safe, reliable and controlled manner. These advantages more than outweigh the increase in production costs due to the additional support flange 5.

It is believed that the foregoing description has made apparent a number of modified container embodiments which remain within the ambit of the invention disclosed. This invention is to be limited therefore only by the scope of the appended claims.

What is claimed is:

1. A container which can be opened with one hand, comprising a base for receiving a contained product and a cover pressed on to the base, wherein the base is provided below the cover with a support flange which at least partially encompasses said base and which has a width for supporting of fingers of the container user.

2. A container according to claim 1 wherein the support flange is joined to said base at a shoulder juncture and slopes outwardly to form a frustum.

3. A container according to claims 1 or 2 wherein the outer edge portion of the support flange is downwardly curved.

4. A container according to claim 1 wherein the support flange is integrally formed with the base.

5. A container according to claim 1 wherein the support flange comprises a discrete element which can be secured to said base.

6. A container according to claim 5 wherein the support flange is made from an elastic material and a support portion is formed on the base which supportingly engages said support flange.

7. A container according to claim 1 wherein the support flange is secured to said base under in a friction fit.

8. A container according to claim 1 wherein the support flange is secured to said base by means of an adhesive.

9. A container according to claim 1 wherein the support flange is soldered or welded to the base.

10. A container according to claim 1 wherein the support flange has a smooth upper surface.

11. A container according to claim 1 wherein the support flange comprises two partial flanges provided at two diametrically opposite points on said base.

12. A container according to claim 11 wherein the edge of the bottom of the base is at least partially coated with a soft plastic or latex.

13. A container according to claim 1 wherein in the normal position of container use, the outer edge of the support flange is located below the plane formed by the bottom of said base.

14. A container according to claim 13 wherein said outer edge is at least partially coated with soft plastic or latex.

15. A container according to claim 1 wherein the upper edge of the cover has a larger diameter than its underlying peripheral outer face.

16. A container according to claim 1 wherein the peripheral outer face of the cover is provided with one or more peripheral tori or ribs.

17. A container according to claim 1 wherein the outer face of the cover has a staircase or shark's tooth profile in vertical section which prevents the fingers from sliding off in the upward direction.

18. A container comprising a receptacle portion for containing a product to be dispensed; a cover disposed on top of said receptacle portion for covering the contents disposed in said receptacle portion; said cover being secured to said receptacle portion in such a manner as to require movement in a direction away from said receptacle portion for purposes of removing said cover from said receptacle portion; finger support means secured to and disposed about at least a portion of the periphery of said receptacle portion and located adjacent said cover in the normal position of container assembly so as to provide a finger-supporting base whereby the cover may be moved away from the receptacle portion by the fingers of one hand for purposes of removing said cover from said receptacle portion.

* * * * *